US007229363B2

(12) United States Patent
Kasashima

(10) Patent No.: US 7,229,363 B2
(45) Date of Patent: Jun. 12, 2007

(54) GOLF BALL

(75) Inventor: Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 261 days.

(21) Appl. No.: 10/378,910

(22) Filed: Mar. 5, 2003

(65) Prior Publication Data

US 2003/0171167 A1 Sep. 11, 2003

(30) Foreign Application Priority Data

Mar. 8, 2002 (JP) ..... 2002-063913

(51) Int. Cl.
*A63B 37/12* (2006.01)
*A63B 37/14* (2006.01)

(52) U.S. Cl. ..... 473/379; 473/383

(58) Field of Classification Search ..... 473/378–385
See application file for complete search history.

(56) References Cited

U.S. PATENT DOCUMENTS 4,869,512 A 9/1989 Nomura et al.
D319,676 S * 9/1991 Ihara ..... D21/709
5,722,903 A * 3/1998 Moriyama et al. ..... 473/384
6,358,191 B1 * 3/2002 Greever ..... 493/34
6,527,654 B2 * 3/2003 Sajima ..... 473/383
6,595,876 B2 * 7/2003 Kasashima et al. ..... 473/382

FOREIGN PATENT DOCUMENTS

JP 05084329 A * 4/1993
JP 2000225214 A * 8/2000
JP 2001212260 A * 8/2001
JP 2001-321460 A 11/2001

* cited by examiner

*Primary Examiner*—Eugene Kim
*Assistant Examiner*—Alvin A. Hunter, Jr.
(74) *Attorney, Agent, or Firm*—Sughrue Mion, PLLC

(57) ABSTRACT

A golf ball having a plurality of dimples arranged on its surface is provided wherein the ball surface is free of a great circle that does not intersect with dimples, at least 7% of the total number of dimples are non-circular dimples, and some non-circular dimples lie across the equator of the ball corresponding to a parting plane of a mold. The ball is improved in flight distance and aerodynamic uniformity.

18 Claims, 5 Drawing Sheets

GOLF BALL

TECHNICAL FIELD

This invention relates to a golf ball having dimples optimized so as to perform well in flight.

BACKGROUND OF THE INVENTION

In most golf balls, a plurality of dimples are arranged on their surface. Many attempts have been made to tailor the shape and arrangement of dimples for the purpose of improving the aerodynamics of the flight of golf balls, specifically maximizing the flight distance while preventing the golf ball from turning aside in a vertical or lateral direction. The common approach employs either dimples of one type which are circular as viewed in a plane or dimples of plural types which differ in diameter and/or depth. In some cases, non-circular dimples such as polygonal or elliptic dimples are combined with circular dimples. The dimples are arranged throughout the ball surface as uniformly as possible by utilizing polyhedral arrangement patterns.

Commonly used in the molding of golf balls is a mold of the type that is divided at an equator plane into a pair of mold sections which are mated to define a spherical cavity, the cavity being provided on the inner wall surface with a plurality of protrusions for shaping dimples. For the convenience of working of such molds, no dimple-shaping protrusions are located in the parting plane where the mold is divided. As a consequence, an endless land where no dimples lie is formed along the equator of the golf ball. This endless land interrupts the continuity of dimple arrangement between one hemisphere and the other hemisphere of the golf ball. Then the golf ball lacks the uniformity of flight performance that the ball when hit travels straightforward independent of the spinning direction in flight.

Golf balls which are improved in flight uniformity by laying dimples on the equator have been proposed as described in JP-A 2001-321460. In golf balls of such prior art approaches, to avoid a complication of mold manufacture, the dimples lying on the equator of the ball in alignment with the parting line of the mold must be limited to circular ones, and the number of the dimples lying on the equator must be minimized. An attempt to further improve the golf ball having some dimples laid on the equator, that is, an attempt to improve the uniformity of dimple arrangement and increase the density of dimple arrangement results in an increased expense of mold manufacture due to complication. Given this drawback, for most of the currently available golf balls, the degree of freedom of dimple arrangement is restricted in consideration of the ease of mold manufacture.

SUMMARY OF THE INVENTION

An object of the present invention is to provide a golf ball which is improved in aerodynamic uniformity and flight performance by increasing the degree of freedom of dimple arrangement for optimizing the dimple array.

When a golf ball having a plurality of dimples on the surface is molded in a mold consisting of two upper and lower mold sections adapted to be mated along a parting line, the inventor paid an attention to the shape and arrangement of dimples disposed on the equator of the ball in alignment with the parting line of the mold, and attempted to employ non-circular dimples as some of the dimples on the ball surface, to adjust the proportion of non-circular dimples to circular dimples and to tailor the arrangement pattern thereof. It has been found that by eliminating from the ball surface a great circle that does not intersect with one or more dimples, constructing at least 7% of the total number of dimples as non-circular dimples, and placing at least one non-circular dimple on the equator, the dimples are arranged at maximum uniformity and a high density; and that a golf ball with such dimple arrangement is improved in aerodynamic uniformity and flight performance.

In one aspect, the present invention provides a golf ball having a plurality of dimples arranged on the surface thereof and an equator which is in substantial alignment with a parting plane between a pair of mold sections in which the ball has been molded. The ball surface is free of a great circle that does not intersect with dimples. At least 7% of the total number of dimples are non-circular dimples, at least one of which lies across the equator.

In a preferred embodiment, the non-circular dimples are configured by a combination of at least one arcuate curve with at least one non-arcuate curve or straight line. Preferably, the non-circular dimple that lies across the equator has a major portion on one hemisphere and an off portion on the other hemisphere, the off portion being configured by the arcuate curve. The total area of the non-circular dimples typically accounts for 10 to 90% of the total area of the entire dimples. Also preferably, all the dimples that lie across the equator are non-circular dimples.

In another aspect, the present invention provides a golf ball prepared by molding in a mold comprising a pair of mold sections which are removably mated along a parting plane in alignment with an equator of a spherical cavity to define the spherical cavity, the ball comprising a core, an optional intermediate layer, and a cover having a plurality of dimples on the outer surface thereof. The plurality of dimples include at least one non-circular dimple and generally circular dimples which are shaped by the tip of support pins of circular cross-section disposed near a pole of the cavity for retraction in a direction perpendicular to the paring plane.

DETAILED DESCRIPTION OF THE INVENTION

Figure 1:
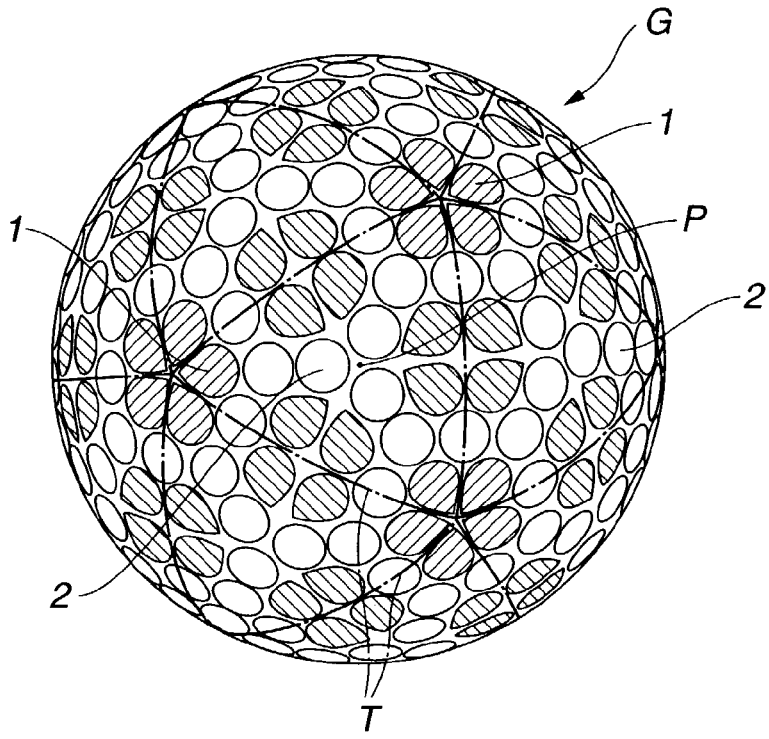
FIG. 1 is a plan view, as viewed from the pole, of a golf ball according to a first embodiment of the invention.
Figure 2:
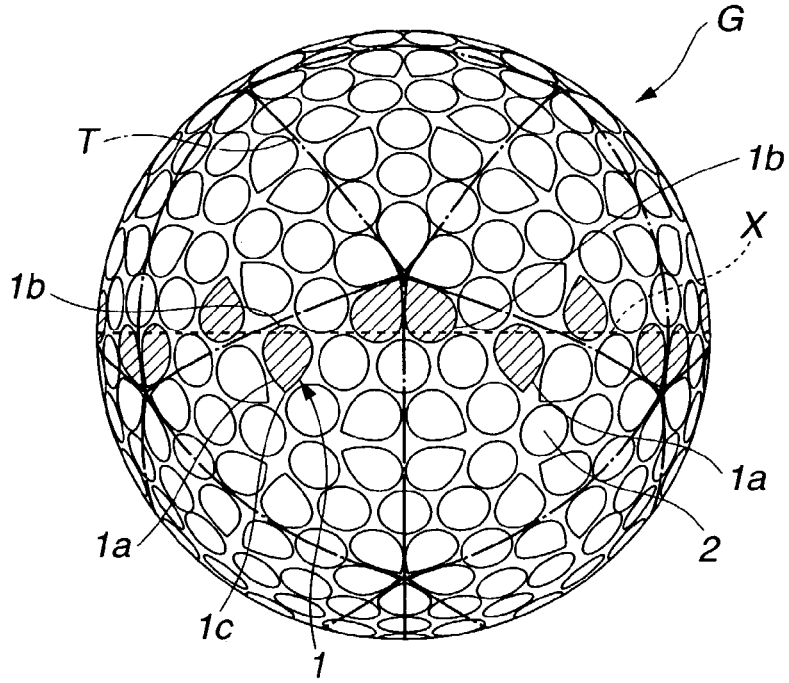
FIG. 2 is a plan view, as viewed from the equator, of the golf ball of FIG. 1.

Referring to FIG. 1, a golf ball G according to a first embodiment of the invention is illustrated in a plan view, as viewed from the pole P. FIG. 2 is a plan view of the golf ball G, as viewed from the equator. It is assumed that the golf ball G has a pair of opposed poles P and an equator X which is one of great circles.

In the golf ball G according to the first embodiment of the invention, dimples are arranged on its surface including dimples 2 which are circular as viewed in a plane, referred to as "circular dimples," hereinafter, and dimples 1 which are non-circular as viewed in a plane, referred to as "non-circular dimples," hereinafter. The shape of a dimple as viewed in a plane refers to the shape of a dimple as viewed in a two-dimensional plane (circumscribed by the edge of the dimple) or from a radial direction with respect to the center of the ball.

In the first embodiment, the total number of dimples is 360. There are included 180 non-circular dimples 1, that is, the non-circular dimples account for 50% of the total number of dimples. Circular and/or non-circular dimples lie across all great circles on the ball surface, that is, a great circle that does not intersect with one or more dimples is absent. As best shown in FIG. 2, twenty four (24) non-circular dimples 1 are arranged so as to lie across the equator X of the ball.

The non-circular dimples 1 on the golf ball of the invention have planar shapes other than a true circle as typified by circular dimples, for example, polygonal shapes such as regular triangle, rectangular and hexagonal, as well as elliptic, track field, petal, heart, star, oval, rhombus, and dewdrop shapes. In the first embodiment illustrated in FIGS. 1 and 2, the non-circular dimples 1 are dewdrop shaped. The dewdrop shape is configured by an arcuate curve 1*b* and a pair of straight lines 1*a* extending from the ends of the arcuate curve 1*b* to a corner 1*c*. Note that the portion of a dewdrop shape defined by the arcuate curve 1*b* is referred to as arcuate portion and the portion defined by the straight lines 1*a* is referred to as angular portion, hereinafter.

In the first embodiment, a regular icosahedral pattern is employed for the dimple arrangement. Specifically, twenty unit regular triangles T are depicted on the spherical surface, as shown by dot-and-dash lines. For each unit triangle T, three dewdrop shaped non-circular dimples 1 are disposed near the three apexes, respectively, and two dewdrop shaped non-circular dimples 1 are disposed along a central portion of each of the three sides and in close proximity to each other. As shown in FIG. 1, the dewdrop shaped dimple 1 near the apex is situated such that its corner 1*c* is directed toward the apex of unit triangle T and the angular portion 1*a* is in substantial coincidence with the included angle of the unit triangle T; and two dewdrop shaped dimples 1 along a central portion of each side are situated such that the arcuate portion 1*b* is faced toward the side and the corner 1*c* is directed toward the center of the triangle T. Note that all dewdrop shaped dimples 1 are depicted as hatched areas in FIG. 1.

In addition to the dewdrop shaped dimples 1, there are included circular dimples 2 of only one type. For each unit triangle T, six circular dimples 2 are disposed around the center of the triangle, and two circular dimples 2 lie on each side such that the circular dimple is equally divided into two halves by the side. Note that in the first embodiment, circular dimples 2 and dewdrop shaped dimples 1 are each equal in area.

As shown in FIG. 2, some dewdrop shaped dimples 1, depicted as hatched areas, lie across the equator X of the ball. Specifically, some dewdrop shaped dimples 1 are situated such that the equator X traverses the arcuate portions 1*b* of the dewdrop shaped dimples. Differently stated, a dewdrop shaped dimple includes a major portion residing on one hemisphere and an arcuate portion (or off portion) 1*b* that extends off the equator and over the other hemisphere.

It is noted that the number of non-circular dimples lying across the equator X of the ball is not limited to the illustrated embodiment (24), but is preferably in the range of 6 to 30.

The type of circular dimples used herein is not critical. In preferred embodiments, dimples of one type or dimples of two to six types which differ in diameter and/or depth are used while the diameter falls in the range of 2 to 5 mm and the depth in the range of 0.07 to 0.40 mm. In the case of non-circular dimples, such dimples of one or more types may be used while their size is in accord with the area and depth of circular dimples.

Preferably the total area of dimples accounts for 75 to 85% of the spherical surface area of the ball which is assumed to be dimple-free, this proportion being sometimes referred to as percent dimple occupation. A percent dimple occupation within this range ensures flight distance. Note that the total area of dimples is the dimple area multiplied by the total number of dimples, provided that the dimple area is the area of a planar circle circumscribed by the dimple edge (where a dimple merges with the land).

Figure 3:
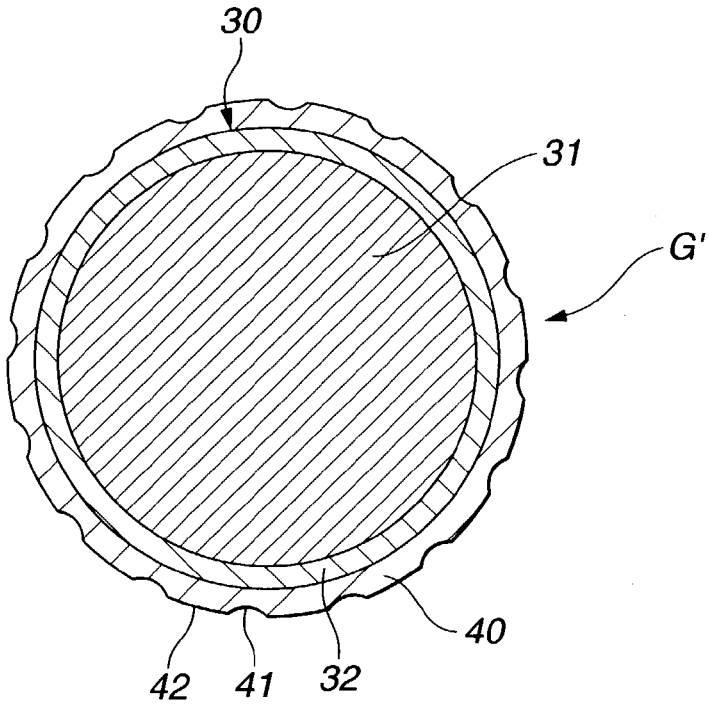
FIG. 3 is a cross-sectional view of a golf ball for illustrating its internal structure.

As described above, the golf ball of the invention is characterized by the shape and arrangement of dimples on the ball surface. No particular limits are imposed on the type, structure, material and other factors of the golf ball. The golf ball of the invention can be embodied as a one-piece solid golf ball formed solely of a single elastic material; a two-piece solid golf ball consisting of a core formed of an elastic material, typically rubber and a cover formed around the core from a resin such as an ionomer resin or polyurethane; a multi-piece solid golf ball of three or more layer structure having an intermediate layer between a core and a cover, the intermediate layer including a single layer or two or more layers formed of a resin material having different physical properties from the cover material; and a thread wound golf ball. More particularly, FIG. 3 illustrates as one typical embodiment a three-piece solid golf ball G' comprising an inner sphere 30 having a core 31 of rubber enclosed with an intermediate layer 32 of a resin material, and a cover 40 enclosing the inner sphere 30 and provided on the outer surface with a plurality of dimples 41.

Figure 4:
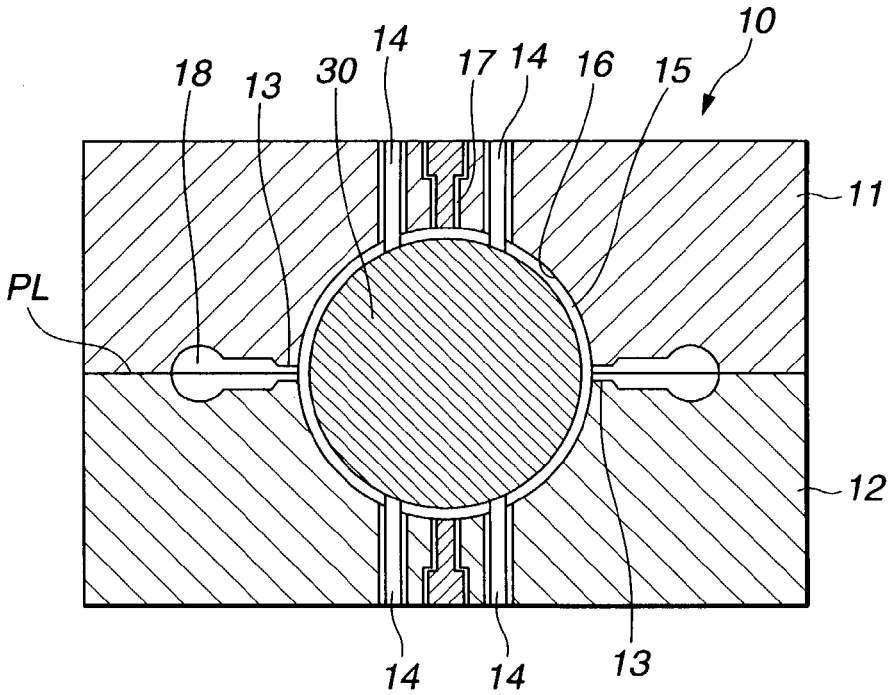
FIG. 4 is a schematic cross-sectional view of a mold consisting of two mold sections for golf balls.

A well-known mold consisting of a pair of upper and lower mold sections may be used in the manufacture of the golf ball of the invention, especially when a cover material is injection molded. Referring to FIG. 4, a typical mold is illustrated as comprising a pair of mold sections 11 and 12 which are removably mated along a parting plane PL to define a spherical cavity 15 therein. The spherical cavity 15 is provided on its inner wall surface with a plurality of dimple-shaping protrusions (not shown) for shaping dimples on the surface of a ball being molded therein. The equator (not particularly depicted) of the spherical cavity corresponds to the parting plane PL of the mold. At the position of mold parting plane PL, the mold includes a runner 18 disposed so as to surround the cavity 15, and a plurality of, typically four to twelve equi-spaced gates 13 extending radially inward from the runner 18 for feeding the cover material from the runner 18 into the cavity. The spherical cavity 15 is provided on its inner wall surface with a plurality of dimple-shaping protrusions (not shown) for shaping circular or non-circular dimples on the ball surface. Some of the dimple-shaping protrusions correspond to those non-circular dimples (dewdrop shaped dimples 1 in the first embodiment) which extend from one hemisphere to the other hemisphere of the ball. For the convenience of mold manufacture, it is preferred that a non-circular dimple be situated across the equator such that the off portion of a non-circular dimple which extends off the equator is the arcuate portion rather than the angular portion. Then the mold parting plane is constructed by a series of straight segments in agreement with the equator and arcuate portions of non-circular dimples, which significantly facilitates the mold manufacture. If the off portion of a non-circular dimple which extends off the equator is the angular portion or the corner, the shape of the mold parting plane should correspond to that shape, which makes the mold manufacture complicated and cumbersome, resulting in an increased expense. On repeated use of the mold, such corners are abraded away, with a possibility for burrs to form thereat. It is thus undesirable that the off portion of a non-circular dimple be the angular portion.

The parting plane PL of the mold used in molding of the golf ball of the invention includes partially concave or convex portions corresponding to the shape of some non-circular dimples extending off the equator while the remaining portions are formed straight along the equator of the ball. The distance of a dimple-shaping protrusion that extends off the equator is preferably in the range of 0.1 to 2.0 mm from the equator because a setting in this range facilitates the removal of the golf ball from the mold immediately after molding.

In FIG. 4, the mold further includes support pins 14 and vent means 17. For each mold section, three support pins 14 are disposed on the cavity inner wall surface 16 at intervals of 120° along an imaginary circle drawn about the pole of the spherical cavity 15, and extend vertically into the mold cavity for supporting the inner sphere 30 in place. The cross section of the support pin is circular, and its tip is configured as a protrusion for shaping a circular dimple. The support pins 14 are mounted in openings of circular cross section in the mold sections for retraction in a vertical direction. When the support pins 14 are in the forward position as shown in FIG. 4, they support the inner sphere 30 in place. The cover material is fed into the cavity 15 in this condition, after which the support pins 14 are retracted to the position of the cavity inner wall surface 16 where the tips of the support pins 14 serve to shape circular dimples 2 in the cover being molded. The dimple impressed by the support pin 14 in the illustrated embodiment is formed as a somewhat elliptically modified circular shape because the tip face of the support pin is not parallel with the spherical cavity surface and is inclined thereto.

The cover material to be injected in the mold may be any well-known resinous cover stock. In the mold, the injection gates 13 each have a cross-sectional area of 0.2 to 2.0 $mm^2$ and are provided in a total number of 4 to 20 and in fluid communication with the cavity 15 at the position of the equator and oriented radially toward the center of the cavity.

Figure 5:
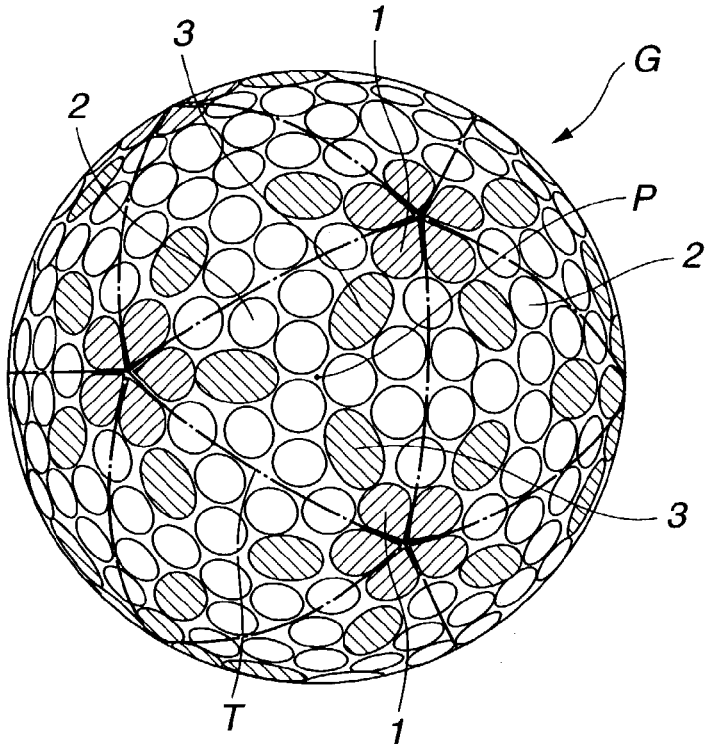
FIG. 5 is a plan view, as viewed from the pole, of a golf ball according to a second embodiment of the invention.
Figure 6:
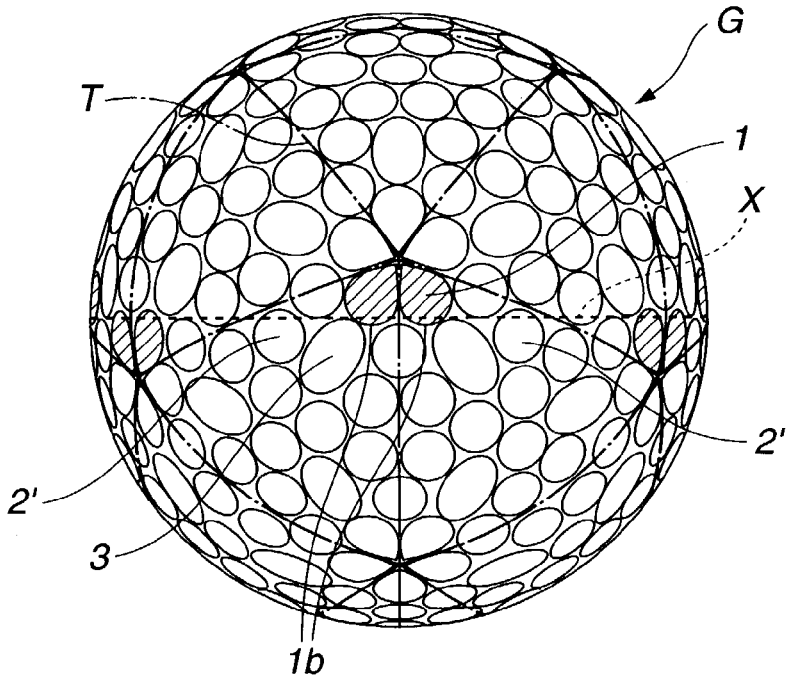
FIG. 6 is a plan view, as viewed from the equator, of the golf ball of FIG. 5.

FIGS. 5 and 6 illustrate a golf ball G according to a second embodiment of the invention. FIG. 5 is a plan view of the ball as viewed from the pole P and FIG. 6 is a plan view of the golf ball as viewed from the equator X.

Like the first embodiment, the second embodiment employs the regular icosahedral pattern of dimple arrangement. Specifically, twenty unit regular triangles T are depicted on the spherical surface, as shown by dot-and-dash lines. For each unit triangle T, three dewdrop shaped non-circular dimples 1 are disposed near the three apexes, respectively, and three track field shaped non-circular dimples 3 are disposed adjacent to the corresponding dewdrop shaped dimples 1 and nearer to the center of the triangle. For each unit triangle T, in addition to the three dewdrop shaped dimples 1 and three track field shaped dimples 3, circular dimples 2 are closely disposed in the remaining region.

In the second embodiment, the total number of dimples is 360. There are included 120 non-circular dimples (60 dewdrop shaped dimples 1 and 60 track field shaped dimples 3), that is, the non-circular dimples account for 33.3% of the total number of dimples. Like the first embodiment, there is no great circle that does not intersect with one or more dimples. In FIG. 5, all non-circular dimples (including dewdrop shaped dimples 1 and track field shaped dimples 3) are depicted as hatched areas.

In the second embodiment, as shown in FIG. 6, twelve non-circular dimples (dewdrop shaped dimples 1) per ball are disposed to lie across the equator X. Like the first embodiment, the non-circular dimples lying across the equator X of the ball are only dewdrop shaped dimples 1 in the second embodiment. These dewdrop shaped dimples 1 are disposed such that their arcuate portion 1*b* extends slightly off the equator. In the second embodiment, some circular dimples 2' are also disposed so as to lie across the equator X. The number of circular dimples 2' lying across the equator is twelve per ball.

Figure 7:
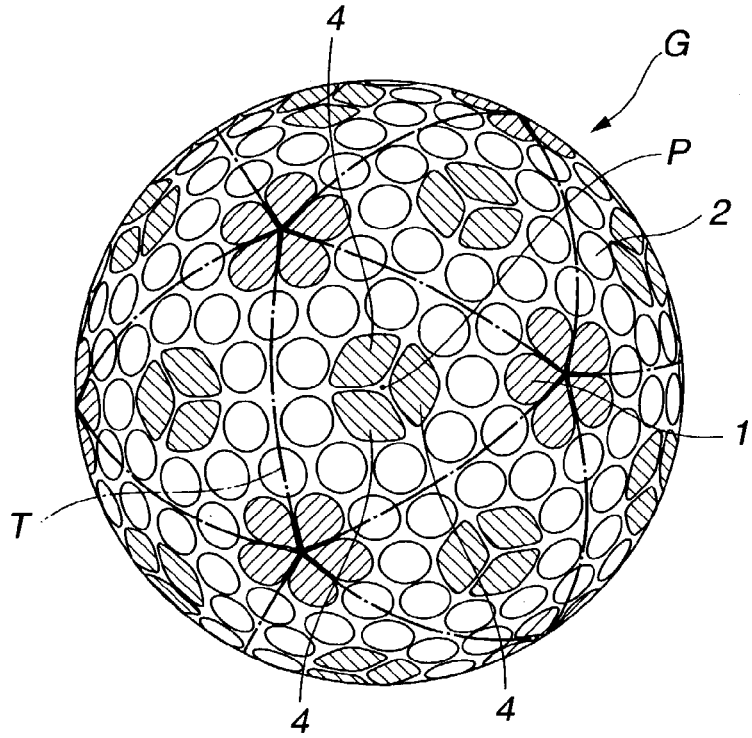
FIG. 7 is a plan view, as viewed from the pole, of a golf ball according to a third embodiment of the invention.
Figure 8:
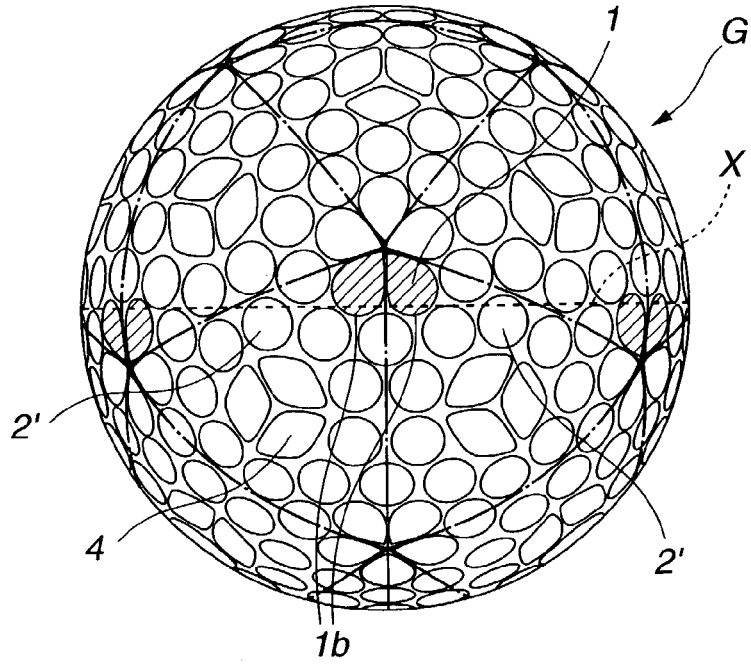
FIG. 8 is a plan view, as viewed from the equator, of the golf ball of FIG. 7.

FIGS. 7 and 8 illustrate a golf ball G according to a third embodiment of the invention. FIG. 7 is a plan view of the ball as viewed from the pole P and FIG. 8 is a plan view of the golf ball as viewed from the equator X.

Like the first and second embodiments, the third embodiment employs the regular icosahedral pattern of dimple arrangement. Specifically, twenty unit regular triangles T are depicted on the spherical surface, as shown by dot-and-dash lines. For each unit triangle T, three dewdrop shaped non-circular dimples 1 are disposed near the three apexes, respectively, and three rhombus shaped non-circular dimples 4 which are larger than the dewdrop shaped dimples 1 are disposed about the center of the triangle. For each unit triangle T, in addition to the three dewdrop shaped dimples 1 and three rhombic dimples 4, circular dimples 2 are closely disposed in the remaining region.

In the third embodiment, the total number of dimples is 360. There are included 120 non-circular dimples (60 dewdrop shaped dimples 1 and 60 rhombic dimples 4), that is, the non-circular dimples account for 33.3% of the total number of dimples. Like the first and second embodiments, there is no great circle that does not intersect with one or more dimples. In FIG. 7, all non-circular dimples (including dewdrop shaped dimples 1 and rhombic dimples 4) are depicted as hatched areas.

In the third embodiment, as shown in FIG. 8, twelve non-circular dimples (dewdrop shaped dimples 1) are disposed to lie across the equator X. Like the first and second embodiments, the non-circular dimples lying across the equator X of the ball are only dewdrop shaped dimples 1 in the third embodiment. These dewdrop shaped dimples 1 are disposed such that their arcuate portion 1*b* extends slightly off the equator. In the third embodiment, twelve circular dimples 2' are also disposed so as to lie across the equator X.

EXAMPLE

Examples of the invention are shown below together with Comparative Examples for illustrating the invention, but they are not to be construed as limiting the invention thereto.

Examples 1–3 & Comparative Example 1

Golf balls of Examples 1 to 3 and Comparative Example 1 were prepared as solid golf balls of three-layer structure, as shown in FIG. 3, consisting of a monolithic core made of rubber, an intermediate layer made of a composition comprising an ionomer resin and an olefin elastomer, and a cover made of a polyurethane elastomer base cover stock. In all the balls, the intermediate layer had a gage of 1.65 mm and a Shore D hardness of 61 as measured on its outer surface; and the cover had a gage of 1.5 mm and a Shore D hardness of 58 as measured on the land of the ball surface.

The design of dimples used in Examples and Comparative Example is shown in Table 1. In all the golf balls, the dimple arrangement is a regular icosahedral pattern, and there is no great circle that does not intersect with one or more dimples. The golf ball of Example 1 corresponds to FIGS. 1 and 2; the golf ball of Example 2 corresponds to FIGS. 5 and 6; and the golf ball of Example 3 corresponds to FIGS. 7 and 8. The shape, diameter, depth, area and number of dimples on these golf balls are as shown in Table 1.

Figure 9:
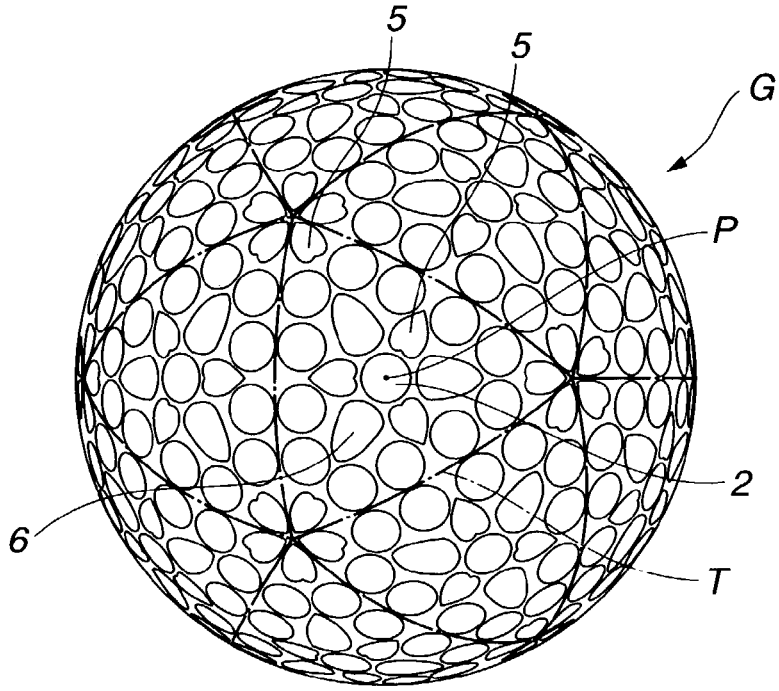
FIG. 9 is a plan view, as viewed from the pole, of a golf ball of Comparative Example 1.
Figure 10:
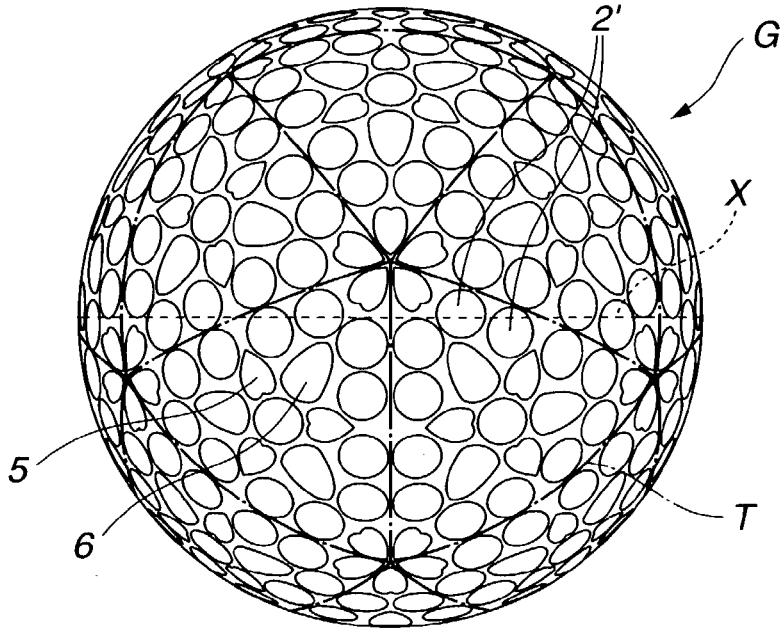
FIG. 10 is a plan view, as viewed from the equator, of the golf ball of FIG. 9.

The golf ball of Comparative Example 1 has a dimple arrangement as shown in FIGS. 9 and 10. For each unit triangle T, three heart shaped non-circular dimples are disposed near the three apexes, respectively, and three heart shaped dimples 5 and three nail shaped dimples 6 are alternately disposed about one circular dimple 2 disposed at the center of the triangle. In the golf ball of Comparative Example 1, some circular dimples 2' are disposed so as to extend off the equator X over the other hemisphere while none of the non-circular dimples lie across the equator X. The number of circular dimples 2' lying across the equator is 24.

The golf balls of Examples 1 to 3 and Comparative Example 1 were examined by the following tests, with the results shown in Table 2.

In a flight performance test using a hitting machine equipped with a driver (W#1), each ball was hit ten times under conditions: an initial velocity of 67 m/s and a launch angle of 10°. A carry and a total distance (in meter) were measured, and an average thereof was computed.

In an aerodynamic uniformity test, each ball was hit ten times under the same conditions as above. As a measure for evaluating the uniformity of trajectory, a variation of elevation angle (or a difference between maximum and minimum angles) was measured. The ball was rated uniform (OK) for a variation within 0.30 and non-uniform (NG) for a variation greater than 0.30.

TABLE 1

| Dimples | | | | | | | | |
|---|---|---|---|---|---|---|---|---|
| Dimple set | Type (shape) | Diameter (mm) | Depth (mm) | Area ($mm^2$) | Number | | Total volume ($mm^3$) | Area occupation (%) |
| a | Circular | 3.85 | 0.15 | 11.64 | 180 | 360 | 320 | 76 |
| | Dewdrop | — | 0.15 | 12.39 | 180 | | | |
| b | Circular | 3.85 | 0.15 | 11.64 | 240 | 360 | 325 | 81 |
| | Dewdrop | — | 0.15 | 12.39 | 60 | | | |
| | Track field | — | 0.16 | 17.90 | 60 | | | |
| c | Circular | 3.90 | 0.16 | 11.94 | 240 | 360 | 315 | 78 |
| | Dewdrop | — | 0.15 | 12.39 | 60 | | | |
| | Rhombic | — | 0.15 | 14.04 | 60 | | | |
| d | Circular | 3.50 | 0.14 | 9.62 | 260 | 440 | 320 | 65 |
| | Heart | — | 0.13 | 6.26 | 120 | | | |
| | Nail | — | 0.17 | 11.12 | 60 | | | |

TABLE 2

| | | Example | | | Comparative |
|---|---|---|---|---|---|
| | | 1 | 2 | 3 | Example 1 |
| Dimple set | | a | b | c | d |
| Flight distance | Carry (m) | 217 | 217 | 219 | 215 |
| (W#1) | Total (m) | 225 | 226 | 224 | 222 |
| Uniformity | | OK | OK | OK | NG |

As seen from the test data in Table 2, the golf balls of Examples 1 to 3 are satisfactory in flight distance and aerodynamic uniformity. In contrast, the golf ball of Comparative Example 1 travels shorter in both carry and total distance than Examples 1 to 3 and exhibits insufficient aerodynamic uniformity.

There has been described a dimpled golf ball in which non-circular dimples are included and which is of the seamless design, absent a great circle that intersects with one or more dimples. This enables dimples to cover a larger area of the ball surface in a uniform distribution, reducing air resistance. Additionally, non-circular dimples are used as dimples lying across the equator, increasing the degree of freedom of dimple design. These factors contribute to an increased travel distance.

Japanese Patent Application No. 2002-063913 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball having a plurality of dimples arranged on the surface thereof and an equator which is in substantial alignment with a parting plane between a pair of mold sections in which the ball has been molded, wherein the ball surface does not have any great circle that does not intersect with dimples, and at least 7% of the total number of dimples are non-circular dimples which are configured by a combination of at least one arcuate curve and at least one of a non-arcuate curve and a straight line, at least one of which lies across the equator such that a major portion of the at least one of non-circular dimples which is configured by at least one of the non-arcuate curve and the straight line is on one hemisphere and an off portion of the at least one of non-circular dimples which is configured by the arcuate curve is on another hemisphere and the size of the off portion is 0.1 to 2.0 mm from the equator.

2. The golf ball of claim 1 wherein the total area of the non-circular dimples accounts for 10 to 90% of the total area of the entire dimples.

3. The golf ball of claim 1 wherein all the dimples that lie across the equator are non-circular dimples.

4. The golf ball of claim 1 wherein the dimples are composed of circular dimples and non-circular dimples.

5. The golf ball of claim 1 wherein the non-circular dimples have at least one of a polygonal shape comprising a regular triangle shape, a rectangular shape and a hexagonal shape, an elliptic shape, a track field shape, a petal shape, a heart shape, a star shape, an oval shape, a rhombus shape, and a dewdrop shape.

6. The golf ball of claim 1 wherein 6 to 30 non-circular dimples lie across the equator.

7. The golf ball of claim 1 wherein the non-circular dimples are formed of a dewdrop shape which is configured by the arcuate curve and a pair of straight lines extending from ends of the arcuate curve to a corner.

8. The golf ball of claim 1 wherein a total area of the dimples accounts for 75 to 85% of a spherical surface area of the ball which is assumed to be dimple-free.

9. The golf ball of claim 1 wherein the parting plane of the mold used in molding of the golf ball includes partially concave or convex portions corresponding to a shape of at least one non-circular dimple extending off the equator while remaining portions are formed straight along the equator of the golf ball.

10. The golf ball of claim 1 wherein the major portion is configured by two substantially straight lines extending from ends of the arcuate curve to a corner.

11. The golf ball of claim 1 wherein the major portion is configured by a point.

12. The golf ball of claim 11 wherein the point is opposite to a center of said offset portion.

13. The golf ball of claim 1 wherein a regular icosahedral pattern is employed for the dimple arrangement and three non-circular dimples are disposed near the three apexes of twenty unit regular triangles based on the icosahedral pattern.

14. The golf ball of claim 1 wherein the cross-sectional areas of the off portions are substantially the same.

15. The golf ball of claim 1 wherein the surface has only one kind of circular dimples, and the circular dimples have the same diameter.

16. A golf ball having a plurality of dimples arranged on the surface thereof and an equator which is in substantial alignment with a parting plane between a pair of mold sections in which the ball has been molded, wherein the ball surface does not have any circle that does not intersect with dimples, and at least 7% of the total number of dimples are non-circular dimples, at least one of which lies across the equator such that a major portion of the at least one of non-circular dimples is on one hemisphere and an off portion of the at least one of non-circular dimples is on another hemisphere wherein the non-circular dimples are configured by a combination of at least one arcuate curve with at least one non-arcuate curve or straight line, the off portion is configured by the arcuate curve, the non-circular dimples are formed of a dewdrop shape which is configured by the arcuate curve and a pair of straight lines extending from ends of the arcuate curve to a corner, an icosahedral pattern is employed for a dimple arrangement and each of unit triangles which compose the icosahedral pattern has three dewdrop shaped dimples at positions near three apexes of the unit triangle, and the size of the off portion is 0.1 to 2.0 mm from the equator.

17. The golf ball of claim 16 wherein each of the three dewdrop shaped dimples are situated such that a corner of each of the three dewdrop shaped dimples is directed toward one of the three apexes of the unit triangle.

18. The golf ball of claim 16, wherein the parting plane of the mold used in molding of the golf ball includes partially concave or convex portions corresponding to a shape of at least one non-circular dimple extending off the equator while remaining portions are formed straight along the equator of the golf ball.

* * * * *